US011786837B2

(12) United States Patent
Quaglia

(10) Patent No.: US 11,786,837 B2
(45) Date of Patent: Oct. 17, 2023

(54) BUBBLE PRODUCING TOY

(71) Applicant: Brian Quaglia, Rehoboth, MA (US)

(72) Inventor: Brian Quaglia, Rehoboth, MA (US)

( * ) Notice: Subject to any disclaimer, the term of this patent is extended or adjusted under 35 U.S.C. 154(b) by 0 days.

(21) Appl. No.: 16/886,635

(22) Filed: May 28, 2020

(65) Prior Publication Data

US 2021/0086097 A1 Mar. 25, 2021

Related U.S. Application Data

(60) Provisional application No. 62/853,709, filed on May 28, 2019.

(51) Int. Cl.
*A63H 33/28* (2006.01)

(52) U.S. Cl.
CPC ..... *A63H 33/28* (2013.01)

(58) Field of Classification Search
CPC ..... A63H 33/28; B65D 33/08
USPC ..... D21/401–402; 416/70 R
See application file for complete search history.

(56) References Cited

U.S. PATENT DOCUMENTS 1,126,797 A * 2/1915 Lichter ..... A47J 43/1093 416/70 R
1,190,492 A * 7/1916 Way, Jr. ..... B65D 33/08 383/10
1,352,385 A * 9/1920 Rothenhoefer ..... A45B 27/00 416/70 R
1,505,712 A * 8/1924 Kaplan ..... A45B 27/00 416/70 R
2,255,509 A * 9/1941 Lichter ..... A45B 27/00 416/70 R
2,526,863 A * 10/1950 Gilliam ..... B44D 3/06 416/70 R
D180,255 S * 5/1957 Tseng ..... D21/402
2,836,926 A * 6/1958 Tseng ..... A63H 33/28 446/15
2,933,232 A * 4/1960 Bugnone ..... B65D 5/46096 229/117.14
3,249,285 A * 5/1966 Dollheimer ..... B65D 33/08 383/9
3,295,248 A * 1/1967 Knerr ..... A63H 33/28 446/15
3,804,235 A * 4/1974 Anderson ..... B26F 1/02 206/497
D263,062 S * 2/1982 Rasmussen ..... D21/402
4,447,982 A * 5/1984 Gushea ..... A63H 33/28 446/16
D311,272 S * 10/1990 Sampson ..... D3/1
(Continued)

*Primary Examiner* — Eugene L Kim
*Assistant Examiner* — Matthew B Stanczak
(74) *Attorney, Agent, or Firm* — Lainie E. Parker

(57) ABSTRACT

A bubble producing toy which can be made from a single sheet of plastic and a handle. In one embodiment, the same single sheet of plastic can also be used to form the handle as well. The sheet of plastic has one or more diaphragm holes which become bubble producing holes when dipped in bubble solution and the handle has finger holes for the user to hold the toy. When the same single sheet of plastic is also used for the handle, the sheet of plastic is folded so that it attaches to itself in order to form the handle. When the diaphragm holes are placed in bubble solution and the bubble producing toy is blown at or waved or shaken back and forth through the air, bubbles are produced.

19 Claims, 15 Drawing Sheets

(56) References Cited

U.S. PATENT DOCUMENTS 5,041,042 A * 8/1991 Stein ..... A63H 33/28 446/15
5,181,875 A * 1/1993 Hasegawa ..... A63H 33/009 446/15
5,350,332 A * 9/1994 Yu ..... A63H 33/40 416/70 R
5,695,379 A * 12/1997 Ho ..... A63H 33/28 446/15
5,967,161 A * 10/1999 Neal ..... A42B 1/004 135/19.5
6,102,764 A * 8/2000 Thai ..... A63H 33/28 446/15
6,105,773 A * 8/2000 Miller ..... B65D 71/40 206/431
6,139,391 A * 10/2000 Thai ..... A63H 33/28 446/15
6,149,486 A * 11/2000 Thai ..... A63H 33/28 446/15
6,200,184 B1 * 3/2001 Rich ..... A63H 33/28 446/15
D539,165 S * 3/2007 Clark ..... D9/703
D595,828 S * 7/2009 Schwartz ..... D23/366
D742,458 S * 11/2015 Kitzmiller, Jr. ..... D21/568
D795,353 S * 8/2017 Fu ..... D21/402
10,160,574 B2 * 12/2018 Juan ..... B65D 33/243
D860,328 S * 9/2019 Williams ..... D21/402
D860,329 S * 9/2019 Williams ..... D21/402
10,773,180 B2 * 9/2020 Fu ..... B65D 75/30
2002/0076471 A1 * 6/2002 Olsson ..... B65D 75/008 426/86
2010/0034486 A1 * 2/2010 Gram ..... B31D 1/06 383/10
2010/0139137 A1 * 6/2010 Coutu ..... G09F 1/02 40/586
2013/0052906 A1 * 2/2013 Payne ..... A63H 18/02 446/14
2014/0024281 A1 * 1/2014 Lin ..... A63H 33/28 446/15
2015/0237995 A1 * 8/2015 Finch ..... A45F 5/00 294/25
2016/0039559 A1 * 2/2016 Williams ..... B65D 5/46112 229/151
2018/0050278 A1 * 2/2018 Fu ..... A63H 37/00
2020/0038774 A1 * 2/2020 Williams ..... A63H 33/28
2020/0238193 A1 * 7/2020 Quaglia ..... A63H 33/28

* cited by examiner

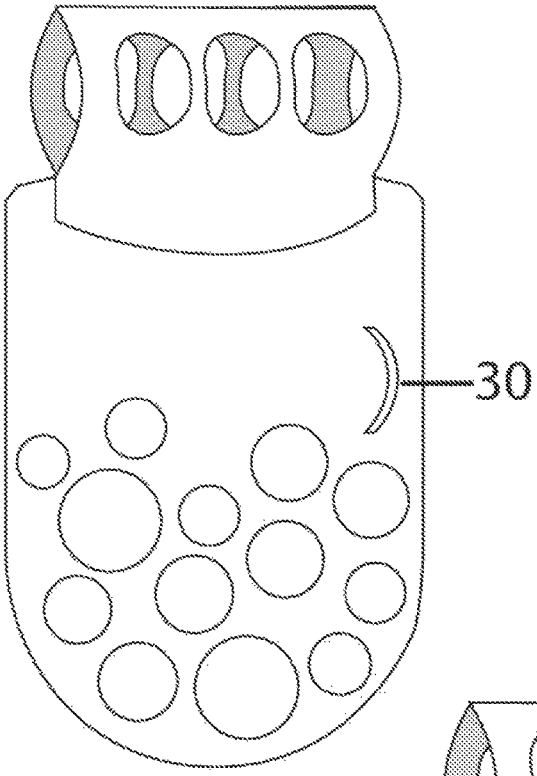
Figure 5A
Figure 5B
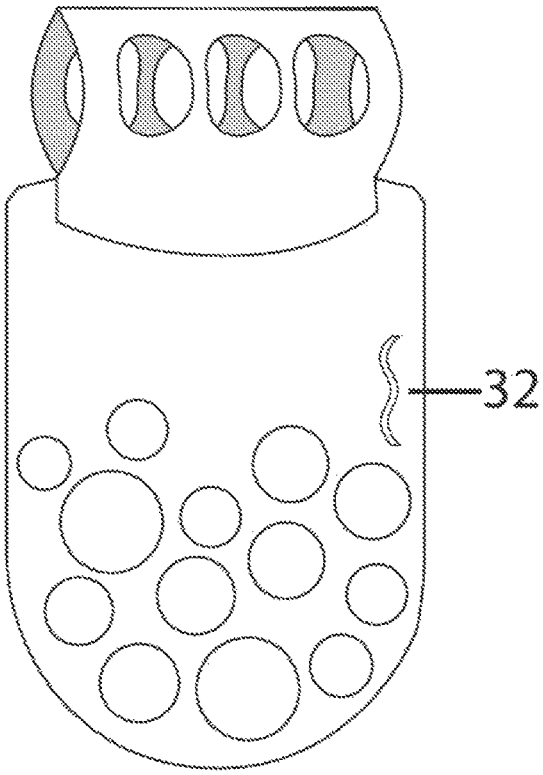
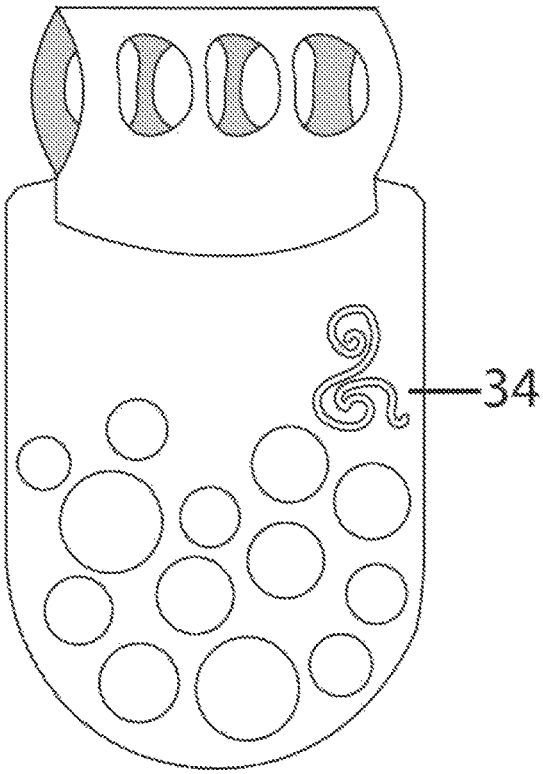
Figure 5C

BUBBLE PRODUCING TOY

CROSS-REFERENCE TO RELATED APPLICATIONS

This application claims priority from Provisional Application No. 62/853,709, filed May 28, 2019, which is incorporated herein by reference in its entirety.

FIELD OF THE INVENTION

The invention is in the field of toys, more specifically in the field of bubble producing toys.

BACKGROUND OF THE INVENTION

Bubble producing toys have been around for some time. In its simplest form a wand is dipped into liquid bubble solution, which forms a film over a dispensing ring, which is a rim or element with a perimeter enclosing an area. Air is blown through the wand or dispensing ring and bubbles are produced until the bubble solution is exhausted. Some wands add a three-dimensional width to the dispensing ring or rim consisting of ridges or protrusions or parallel plates that due to capillary action absorb and hold like a small reservoir bubble solution, and this enables more bubbles to be blown from the wand per dip within bubble solution as the reservoir is drained of bubble solution held within these added features. More complicated bubble production involves motorized fans that continuously blow air combined with pumps that continuously or intermittently pump bubble solution to the dispensing ring upon which the film forms that the air blows through.

BRIEF DESCRIPTION OF THE DRAWINGS

FIG. 5 shows FIGS. 5A, 5B and 5C, all of which are examples of a front view of the bubble producing toy of the invention;

SUMMARY OF THE INVENTION

Figure 1:
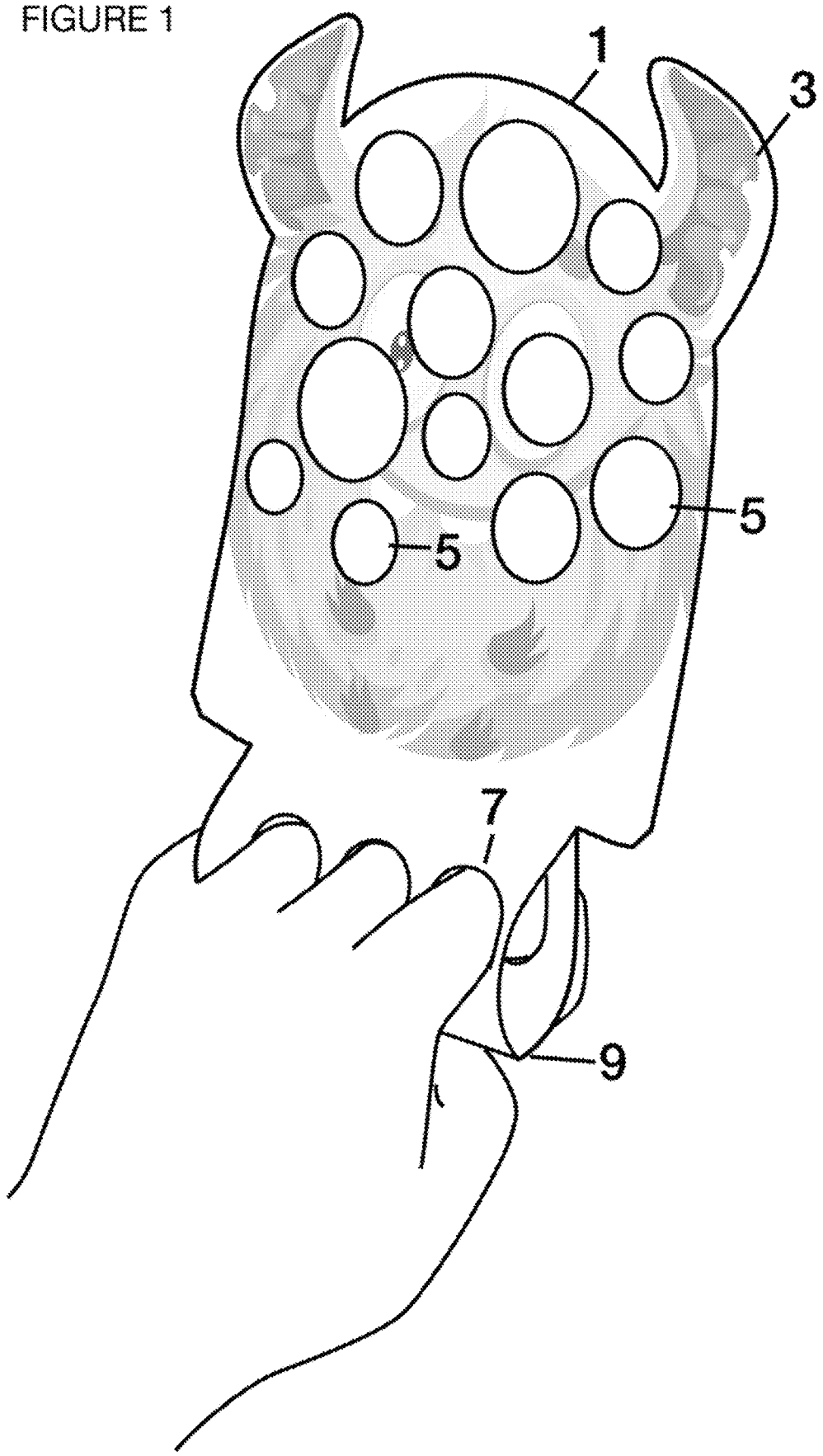
FIG. 1 shows a perspective view of an example of the bubble producing toy of the invention.

One example of the invention is a sheet of plastic or other water-resistant or waterproof rigid or semi-rigid material possessing a front surface and a back surface. An image can be printed on either the front surface or the back surface. The sheet of material forms a paddle for producing bubbles and can also be used to form a handle for holding the paddle, or the handle can be added separately.

The paddle has at least one hole or aperture in it through which bubbles can be produced. This hole or aperture, or multiple holes or apertures are referred to herein as diaphragm holes since they are made in a solid sheet of material. Another reason for referring to such holes or apertures as diaphragm holes is that in some cases the sheet of material is flexible like a diaphragm. Further, the hole or aperture, or multiple holes or apertures can be of all different shapes and sizes.

The handle is attached to or part of the paddle and it has at least one finger-hole (for grasping by one or more fingers). The handle can be grasped or held by the at least one finger using the at least one finger hole or the finger(s) can be inserted through the at least one finger hole(s) to hold the handle loosely. Alternatively, the finger(s) can be inserted through the at least one finger hole(s) and then bent to make a first to more tightly hold the handle.

Once the bubble producing toy of the invention is being held by the handle, the paddle can be dipped into a tray of bubble producing solution so that bubble solution extends across the at least one diaphragm hole or aperture of the paddle. Then when the paddle is lifted out of the tray, air is forced through the at least one diaphragm hole or aperture of the paddle to produce bubbles. The air can be forced through by waving the paddle (up and down, back and forth, etc.) in the air, which works very nicely when the paddle is made of a flexible material, or the holes can be blown through using a user's breath or an electric blower, for example.

Another example of the bubble producing toy comprises:

a paddle and a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being attached to or part of the paddle and having at least one finger-hole for holding the handle by at least one finger, the handle comprising a material having at least one first portion and at least one second portion, the material being folded on one side thereof so that the at least one first portion and the at least one second portion are folded together, the at least one first portion having at least one first portion finger-hole, and the at least one second portion having at least one second portion finger-hole, the at least one first portion finger-hole and the at least one second portion finger-hole aligning when the material is folded, thereby forming at least one finger-hole in the handle for holding the handle by at least one finger.

Yet another example of the invention is a kit including the bubble producing toy, or the basic material to make it, and the packaging can be used as the tray for the bubble solution. Optionally, the kit can include bubble solution and/or concentrated bubble solution which becomes bubble solution when water is added.

Still another example of the bubble producing toy of the invention is made out of a single sheet with a center line and either side is a mirror image of the other. Once the sheet is folded along the center line, it makes the paddle portion of the bubble producing toy of the invention. Then, the handle portion is folded on itself and secured to form the handle and another bubble producing toy is made. It will still have the same diaphragm bubble producing holes and same type of finger inserting handle as the first two examples above.

In any of the examples, the handle is secured to itself (or to the paddle if it is not formed from the same piece of material as the paddle) by any attaching device or method, including but not limited to, thermal welding, melting, cementing, riveting, stitching, stapling, bolting, tab and slot, or other means of attachment.

DETAILED DESCRIPTION OF THE INVENTION

The terms used herein shall have their ordinary and usual meanings as well as any meanings further defined as set forth in the following Definitions section. The meaning set forth in the following Definitions section shall take precedence if there is any dispute between the ordinary and usual meaning and that set forth in the Definitions section.

Definitions

Aperture—As used herein, an aperture refers to an opening of any shape; it does not have to be uniformly shaped; it can be squiggly shaped such that opposing ends come together at points making the shape closed as some points and open at other points;

Blister Package—As used herein, a blister package is a pre-formed package, transparent at least in part, usually made of plastic, made up of at least two separate elements in which at least one is pre-formed, usually shaped to fit the product, and one is its blister board backing, or in this case, some other backing, like the paddle of the invention; the blister package can instead be a clam-shell packing which includes at least two pre-formed elements that close together, e.g., "like a clam";

Bubble Producing Hole—As used herein, a bubble producing hole refers to a hole or aperture through which bubbles can be produced, generally when a bubble producing substance is stretched across the hole and air is directed through it, either by blowing (by a person, by a machine, etc.) or by waving the hole through the air; also the terminology "bubble producing hole" is used interchangeably herein with the terminology "diaphragm hole".

Diaphragm—As used herein, a diaphragm is a sheet of material, it can be a rigid, flexible or a semi-flexible material Diaphragm Hole—As used herein, a diaphragm hole or aperture is a hole in a sheet of material, like a diaphragm; this terminology, "diaphragm hole", is used interchangeably herein with the terminology "bubble producing hole"; also, when the diaphragm is flexible or semi-flexible, then the diaphragm hole is flexible or semi-flexible too and can increase bubble producing enjoyment;

Finger-Hole—a hole of any shape for grasping by one or more fingers;

Free-form-shaped—means a diaphragm hole of a shape made using a free hand and not a standard shape, so it can be a wiggly shape, a blob, etc.

Handle—As used herein, a handle is the part of the bubble producing toy of the present invention which holds the paddle;

Paddle—As used herein, a paddle is the part of the bubble producing toy of the present invention which produces the bubbles The following is a list of components identified in the figures.

COMPONENTS

1 Bubble producing toy
3 horns
5 bubble producing (diaphragm) holes
7 finger-hole
9 fold in material
11 point of attachment for handle
13 staple
15 straight slit
17 single sheet
19 central line
21 hand
23 regular-shaped tab
25 slot
27 arrow-shaped tab
30 curved slit
32 sinuous slit
34 wiggly slit Components and functions of exemplary devices and methods will now be described with reference to the drawings. The following detailed description includes specific details in order to provide a thorough understanding of exemplary bubble producing toys and methods for using the bubble producing toys. Reference is made to the accompanying drawings which form a part hereof, and in which is shown by way of illustration of specific embodiments in which the bubble producing toys and bubble producing toy mechanisms may be constructed implemented. These embodiments are described in sufficient detail to enable those skilled in the art to practice the novel products and methods, and it is to be understood that other embodiments may be utilized and that changes may be made without departing from the spirit and scope of the teachings herein. The following detailed description is, therefore, not to be taken in a limiting sense. Reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

FIG. 1 shows a perspective view of an example of the bubble producing toy 1 of the invention. It is shown being held using a first grip with four fingers through all four of its finger-holes 7. The character play of the image printed on the front of the toy 1 is extended by including horns 3. Any of these types of extension of the image can be included, such as tentacles, arms, legs, nails, claws, teeth, hair accessories, any type of decoration or body part, etc. Also shown are several different sizes of bubble producing or diaphragm holes 5. Alternatively, the bubble producing holes can also have different shapes, by way of non-limiting example, round, oval, box, triangular, rectangular, a free-form made up shape, etc. The paddle and handle of the bubble producing toy of FIG. 1 is made from a single sheet of material and the bend or fold 9 of the material to form the handle can easily be seen in the figure.

The bubble producing holes 5 are also referred to herein as a diaphragm holes 5 because the holes or apertures resemble those in a diaphragm, i.e., a sheet of material, as opposed to a traditional bubble wand in which the holes or apertures are defined specifically by their perimeter. Another reason for referring to them as diaphragm holes is because in many of the examples of the invention, the paddle, or diaphragm, is flexible, like a diaphragm.

Figure 2:
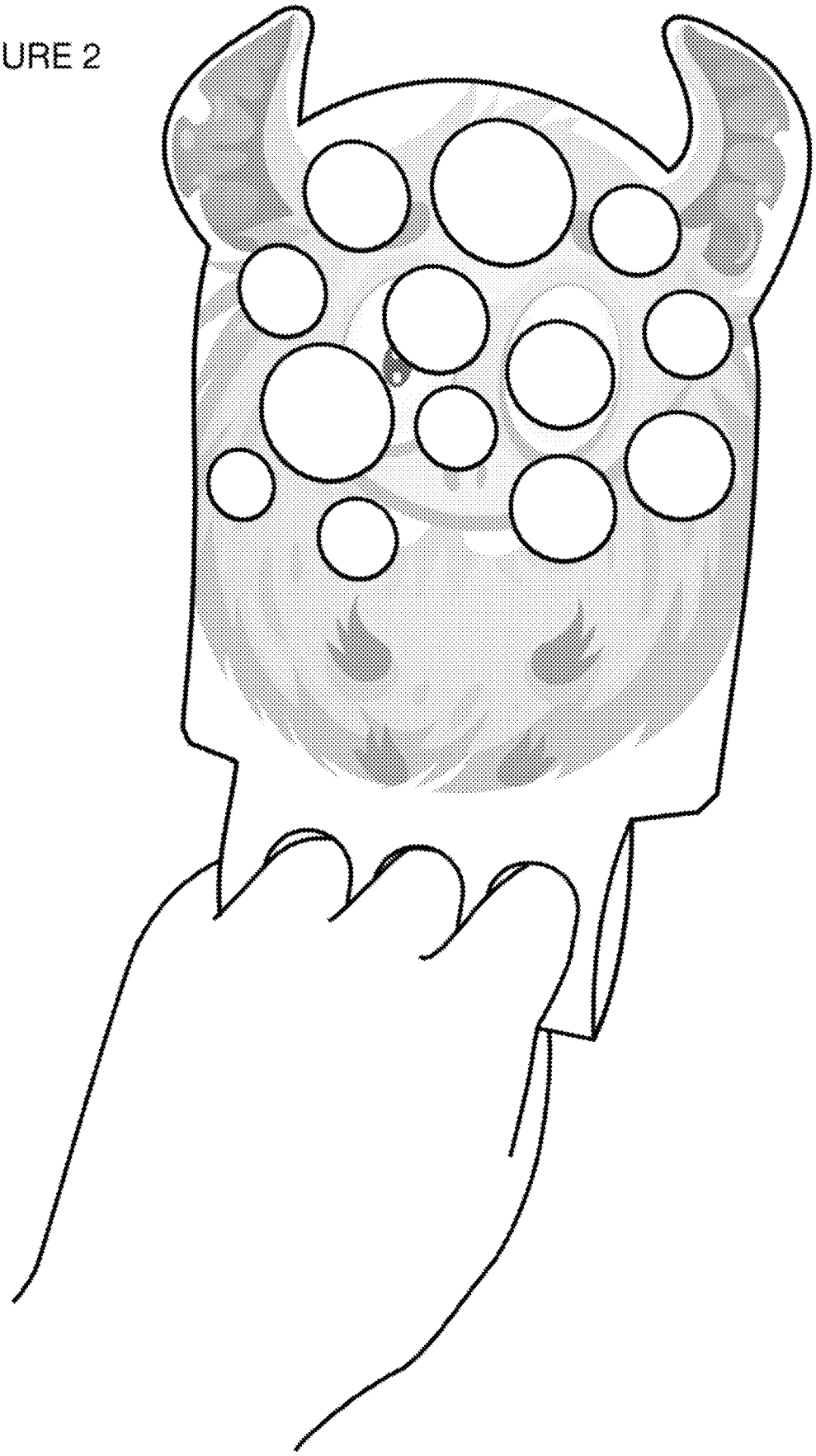
FIG. 2 shows a front view of the bubble producing toy shown in FIG. 1.

FIG. 2 shows a more front facing view of the bubble producing toy shown in FIG. 1.

Figure 3A:
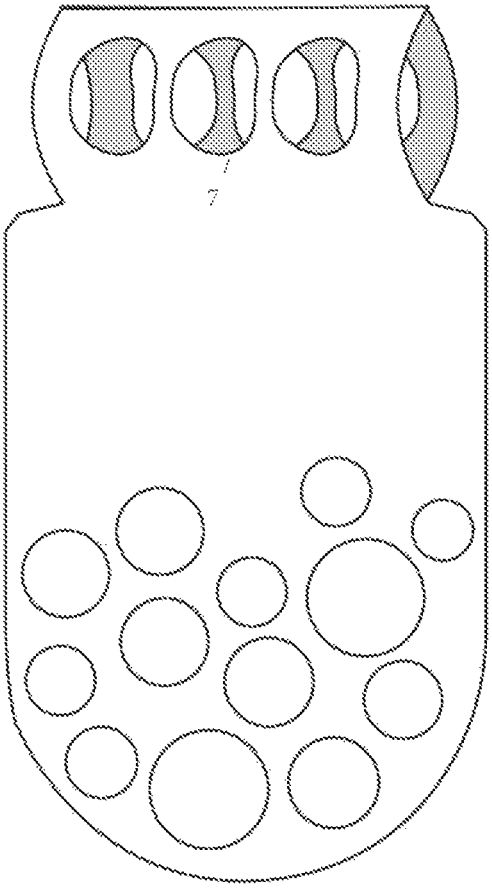
FIG. 3 shows FIG. 3A with an example of the bubble producing toy of the invention, and FIG. 3B with a back view of a bubble producing toy of the invention.
Figure 3B:
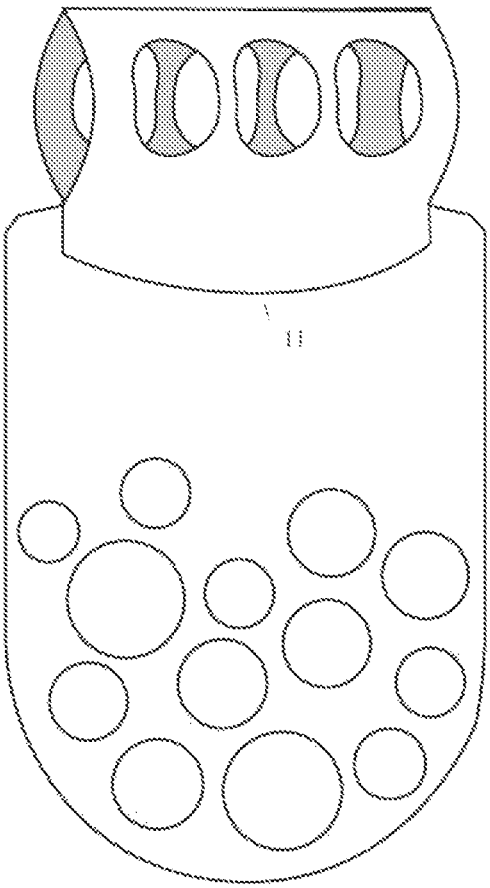

FIG. 3 shows FIGS. 3A and 3B. FIG. 3A is another example of a bubble producing toy of the invention. This one only has three finger holes 7. FIG. 3B specifically points out the point of attachment 11 of the handle once it has been folded over. The method of attachment shown is a heat-sealed strip.

Figure 4:
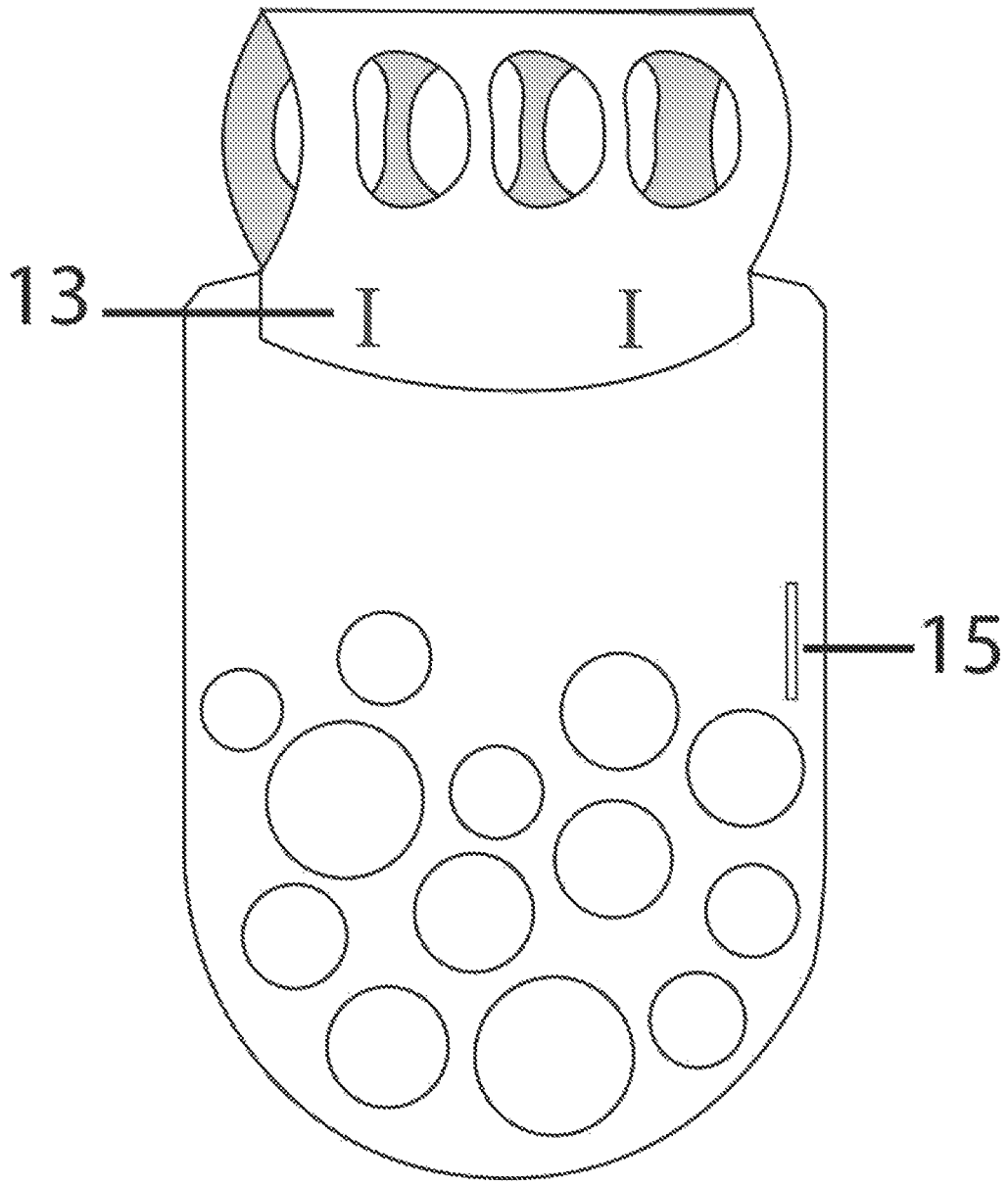
FIG. 4 shows a front view of an example of the bubble producing toy of the invention.

An alternative method of attachment is shown in the example depicted in FIG. 4. There, the handle is attached by staples 13. Also shown is an example of a straight slit 15 can be made radiating out from a perimeter of a diaphragm-hole. FIG. 5A shows an example of a curved slit 30. FIG. 5B shows an example of a sinuous slit 32. FIG. 5C shows an example of a wiggly slit 34. These slits can hold bubble solution and cause the flow of bubble solution due to capillary action when in contact with said bubble solution, similar to the way ridges work on a bubble wand. By using these slits, the toy can produce more bubbles.

Figure 6:
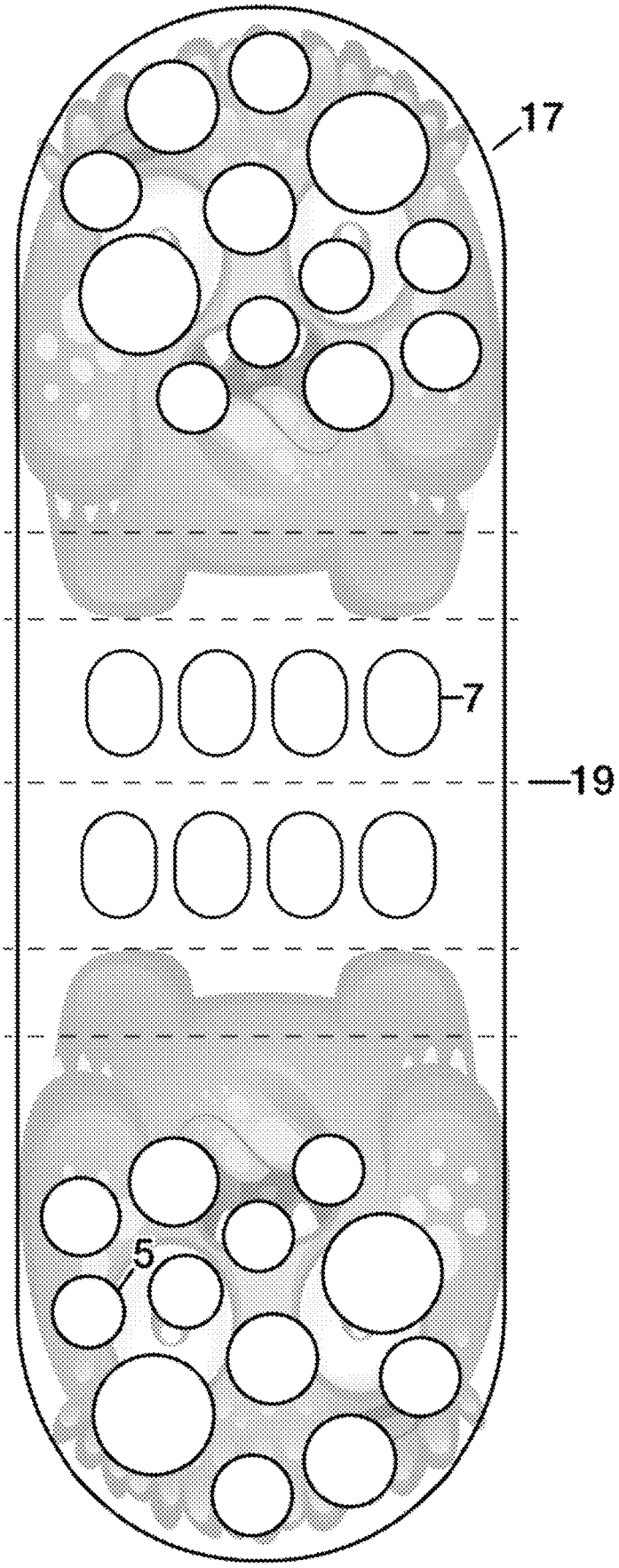
FIG. 6 shows an example of the invention in an unassembled state.

FIG. 6 shows an example of the invention in an unassembled state [single sheet of plastic upon which an image is printed]. depicts a single sheet 17 of plastic upon which an image is printed. The plastic sheet has a top portion and a bottom portion. The top portion and bottom portion both have bubble producing holes over the image of the face. The top portion and bottom portion also both have (finger) gripping holes 7. The sheet of plastic is foldable about a center line 19, and this enables the top portion and bottom portion to be attachable to each other. When attached, the bubble producing holes 5 of both top and bottom portions align to produce holes that pass from front to back of this resultant union, and the gripping holes 7 also align. The alignment and attachment of the top and bottom portions can be from the center line to the most distant points from the center line, with all portions of top area in contact with all portions of the bottom area. There can also be a loop of material in the vicinity of the center line so the area of contact begins at some distance beyond the gripping holes 7.

Figure 7:
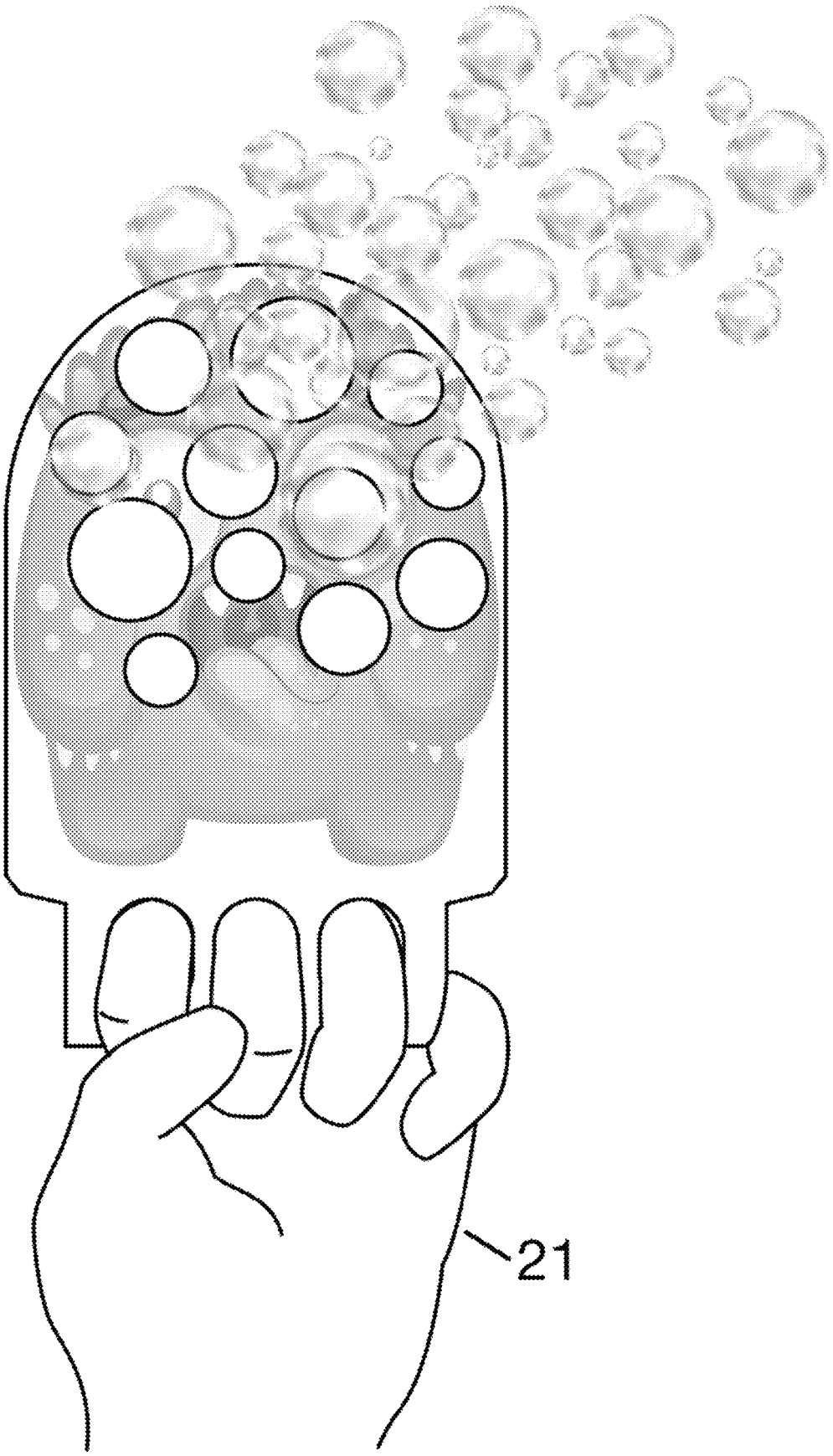
FIG. 7 shows a hand holding an example of the assembled example of the invention depicted in FIG. 6.

FIG. 7 shows a hand 21 holding an example of the assembled example of the invention depicted in FIG. 6 [after it is folded and attached to itself, thus producing a bubble making toy]. depicts a hand holding the assembled single sheet of plastic depicted in FIG. 1 after it is folded and attached to itself, thus producing a bubble making toy. The gripping holes are where fingers of a human hand can be inserted to hold the bubble making toy. The surface is dipped into a liquid bubble solution, which then causes a film to be deposited across the bubble producing holes. When the toy is shaken through the air such that air passes through the holes (in a predominant direction possessing sufficient air-flow direction perpendicular to the plane upon which the bubble films are suspended across the bubble producing holes), bubbles are produced.

Figure 8:
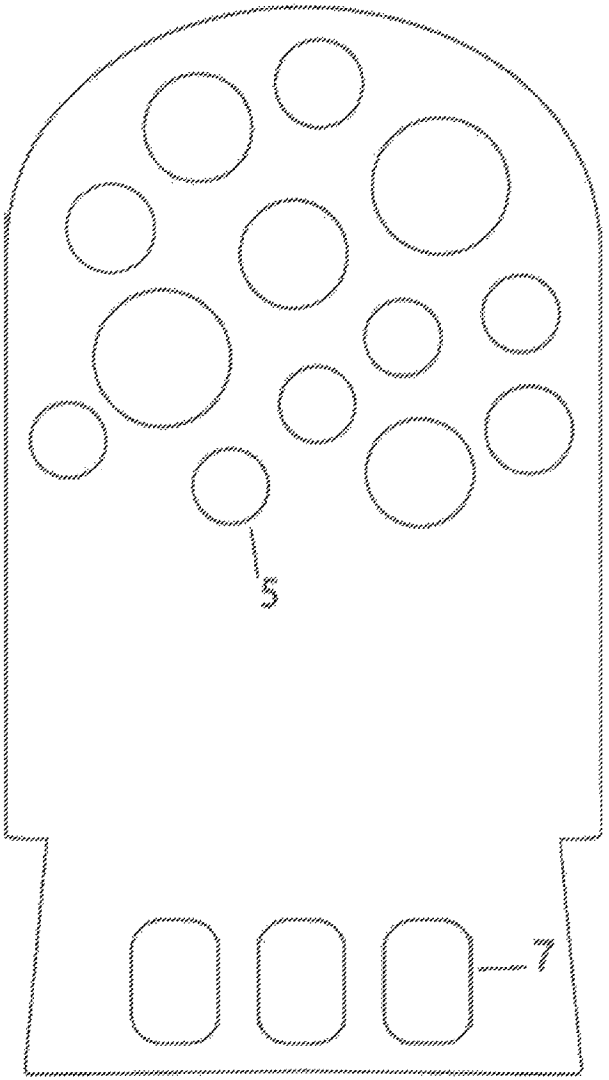
FIG. 8 shows a front view of an example of the bubble producing toy of the invention.

FIG. 8 shows a front view of an example of the bubble producing toy of the invention. It has an image printed thereon and bubble producing holes 5 of four (4) different sizes. The photograph in the figure is altered from making is smaller so that the open space in the area of the finger holes 7 looks filled. The paddle and handle of the bubble producing toy of this example are made from a single plastic sheet and the paddle is very thin and flexible, as can be seen from some of the other figures.

Figure 9:
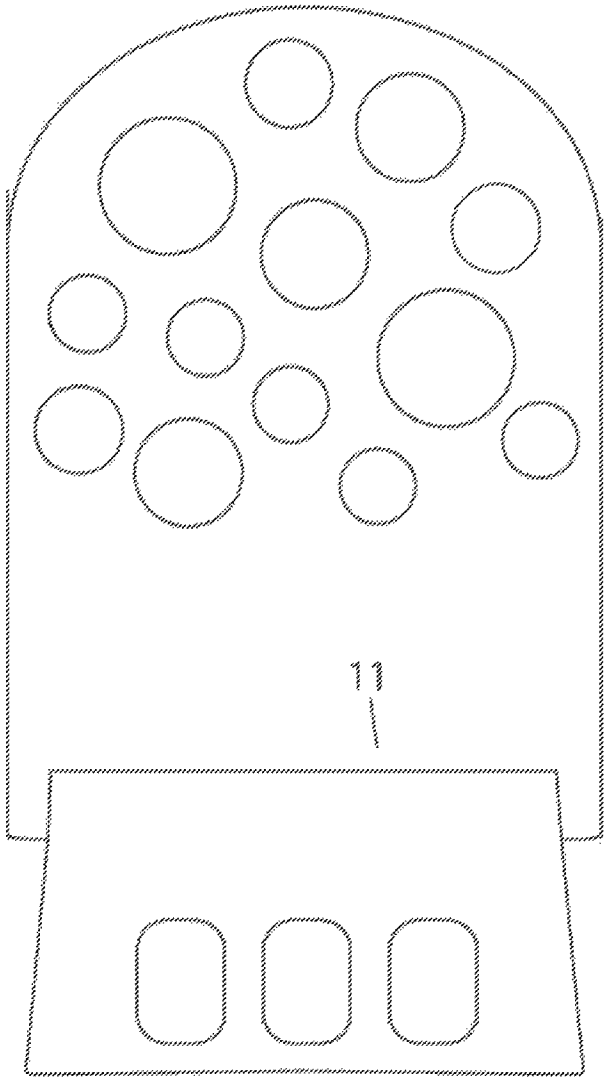
FIG. 9 shows a back view of the bubble producing toy shown in FIG. 8.

FIG. 9 shows a back view of the bubble producing toy shown in FIG. 8. From this view, it can be seen that the image is only printed on the front of the toy. Also, the point of attachment 11 for the handle can be seen in this figure.

Figure 10:
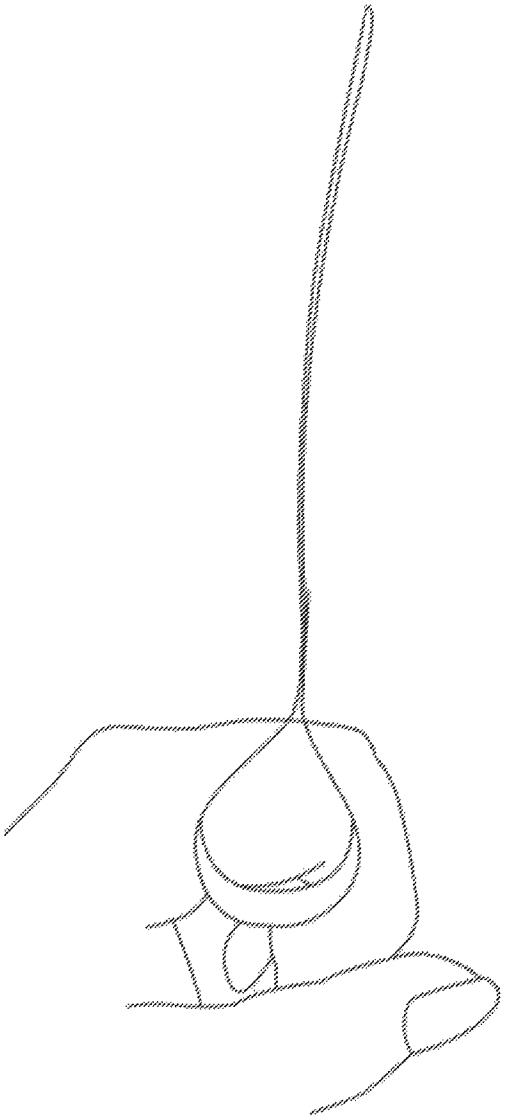
FIG. 10 shows a side view of the bubble producing toy shown in FIG. 8 being held by a hand.

FIG. 10 shows a side view of the bubble producing toy shown in FIG. 8 being held by a hand in a fist. From this side view, the thinness of the paddle is easily seen. Also shown is the empty space where the finger holes 7 are formed. The flexibility of the paddle is also demonstrated in this figure because even though it is a side view, a bit of the back-side of the paddle has twisted itself into view.

Figure 11:
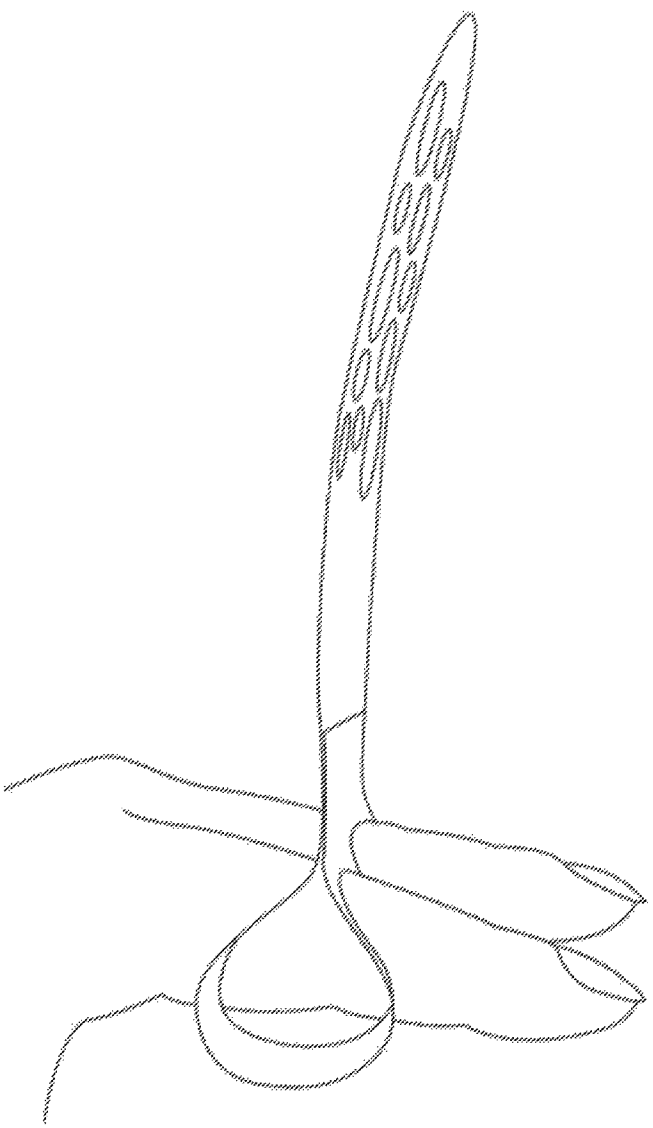
FIG. 11 shows a side view of the bubble producing toy shown in FIG. 8 being held by a hand.
Figure 12:
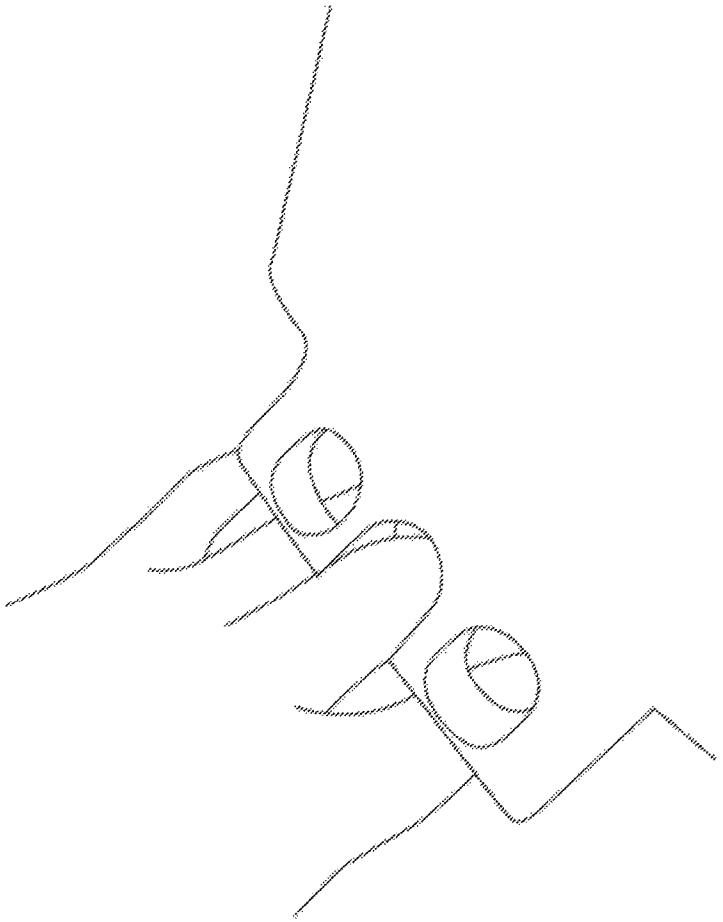
FIG. 12 shows a side view of the bubble producing toy shown in FIG. 8 being held by one finger.
Figure 15:
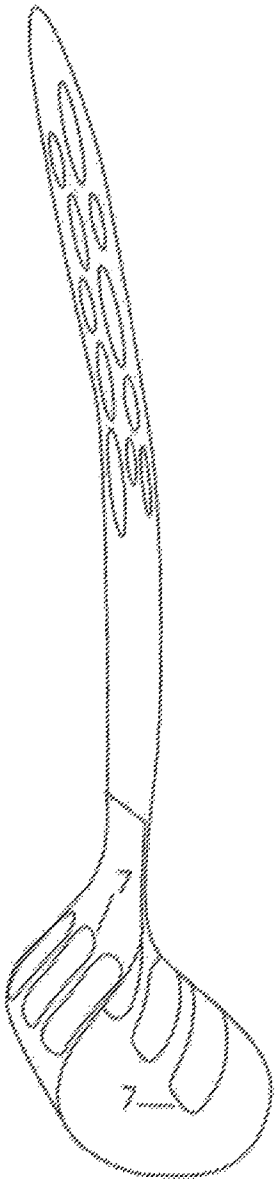
FIG. 15 shows a perspective back view of the bubble producing toy shown in FIG. 8.

FIG. 11 shows a side view of the bubble producing toy shown in FIG. 8, like that shown in FIG. 10, except now the toy is being held by a hand with fingers held out flat instead of in a fist. It is also possible to hold the toy with just one finger, as shown in FIG. 12. Even though FIG. 12 just shows one finger in the middle finger-hole, more than one finger can be inserted into each hole if desired.

Figure 13:
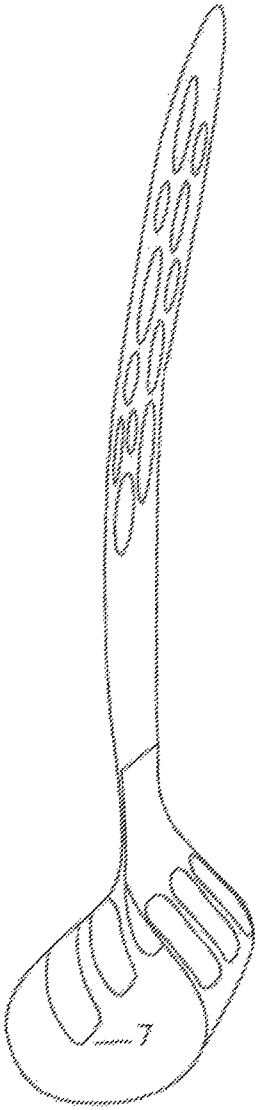
FIG. 13 shows a side view of the bubble producing toy shown in FIG. 8.
Figure 14:
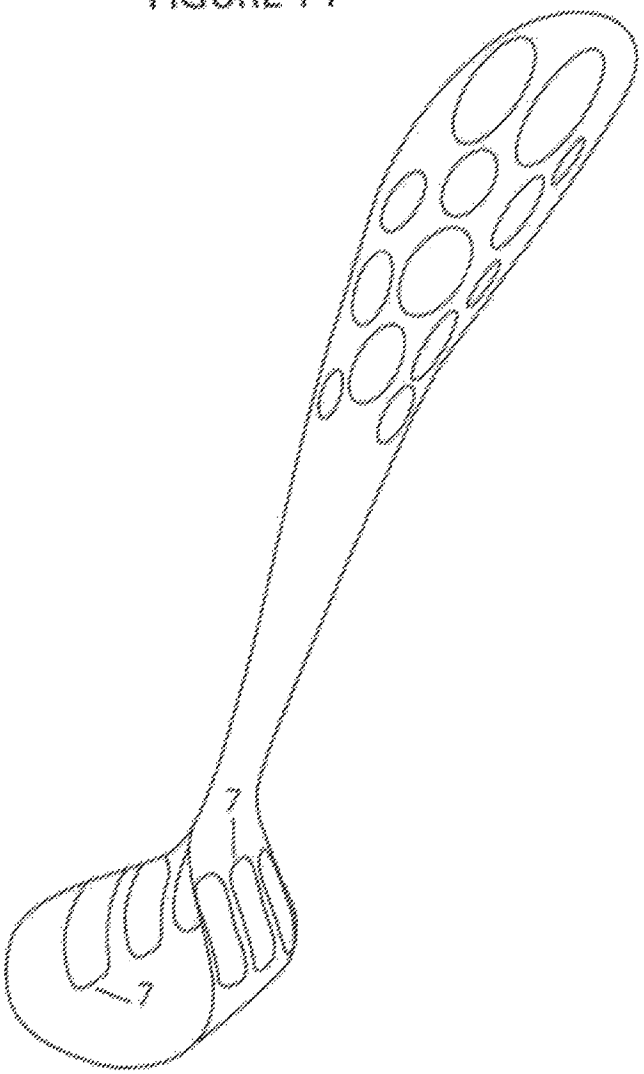
FIG. 14 shows a perspective side view of the bubble producing toy shown in FIG. 8.

FIG. 13 is another side view of the bubble producing toy shown in FIG. 8. This time without any hand holding it by the handle so the space created between the finger holes 7 can easily be seen, as well as the alignment of the finger holes 7 from one portion of the material and the other. The flexibility of the paddle is also shown. These aspects may even be more clearly shown in FIG. 14.

Figure 16:
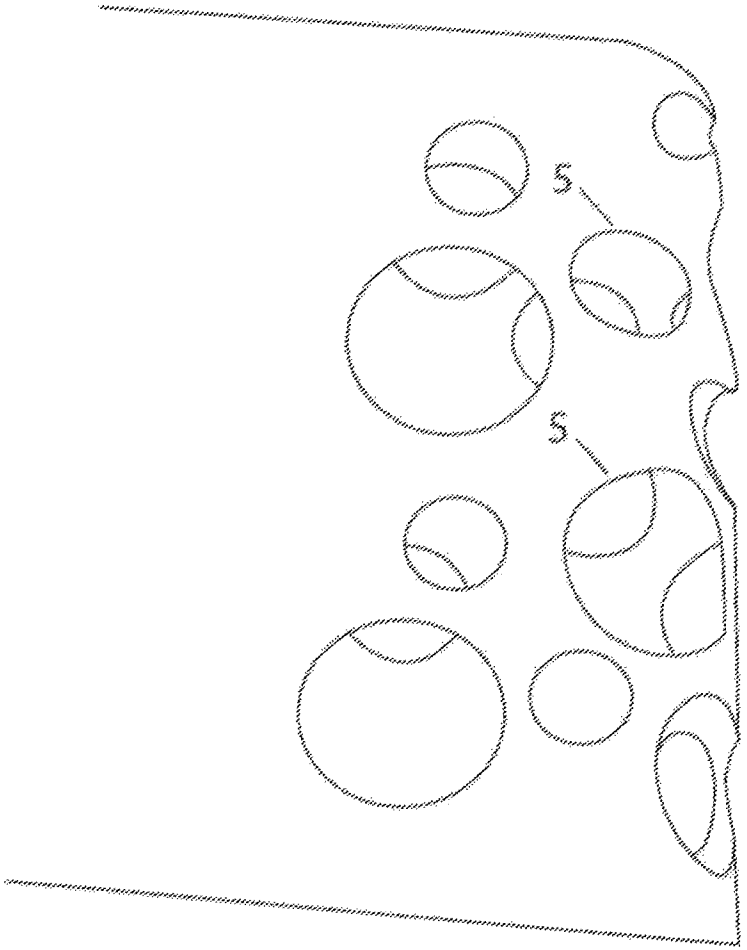
FIG. 16 shows a front view of the bubble producing toy shown in FIG. 8 being bent.

The flexibility of the paddle and the deformation of bubble producing (diaphragm) holes 5 is also well shown in FIG. 16 which shows a front view of the bubble producing toy shown in FIG. 8.

Figure 17:
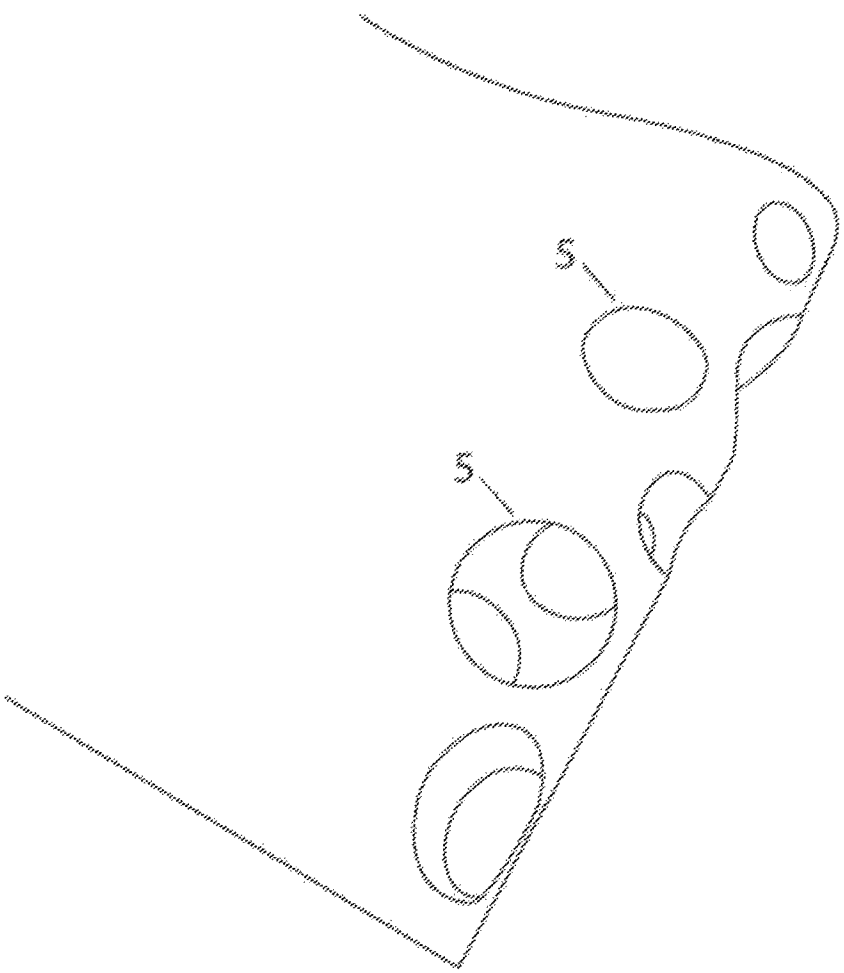
FIG. 17 shows another front view of the bubble producing toy shown in FIG. 8 being bent.

FIG. 17 shows another front view of the bubble producing toy shown in FIG. 8 being bent and it also shows the flexibility of the paddle and the deformation of bubble producing (diaphragm) holes 5 very well.

Figure 18A:
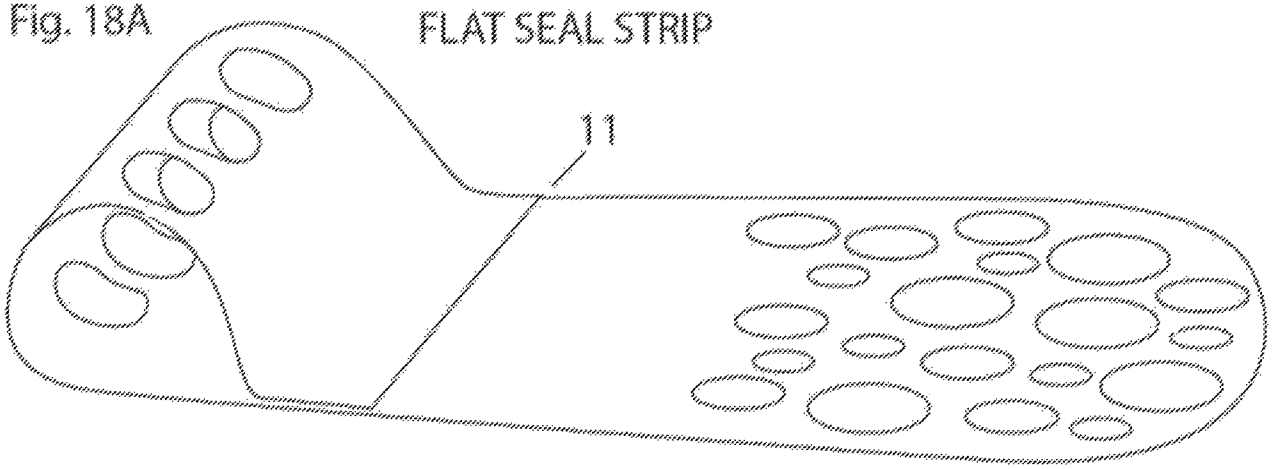
FIG. 18 shows FIG. 18A with a back view of an example of the bubble producing toy of the invention, FIG. 18B with a back view of another example of the bubble producing toy of the invention, FIG. 18C with a back view of another example of the bubble producing toy of the invention, FIG. 18D with an alternate view of the invention shown in FIG. 18C, and FIG. 18E with another type of tab.
Figure 18B:
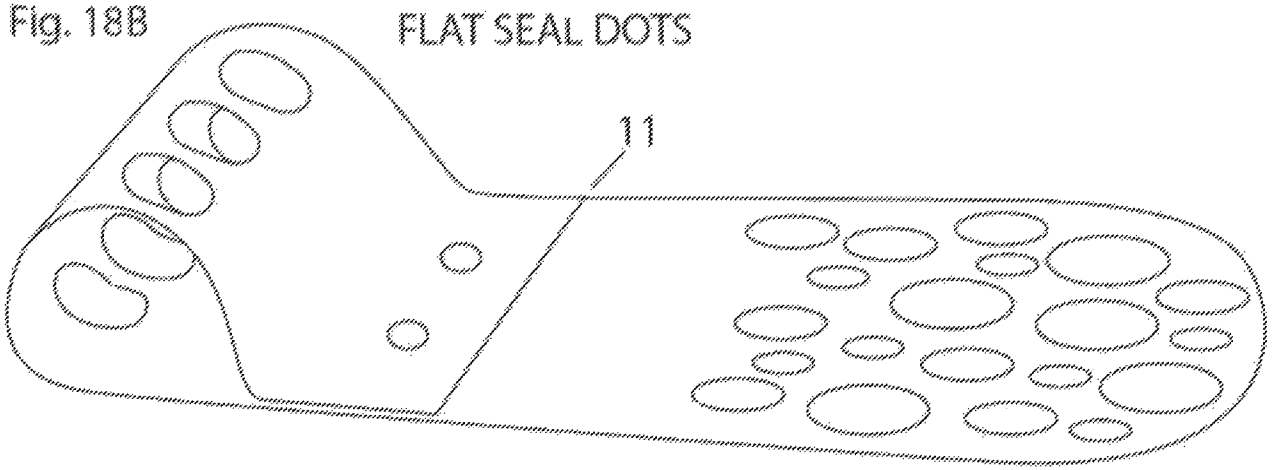

FIG. 18 includes several different figures: including FIG. 18A with a back view of an example of the bubble producing toy of the invention which uses a heat seal strip at the point of attachment 11 to make the handle. It is an example of using a heat seal strip to form the handle by attaching the handle either to another part of the handle or also to the paddle; FIG. 18B with a back view of another example of the bubble producing toy of the invention which uses heat seal dots at the point of attachment 11 to make the handle. It is an example of using heat seal dots to form the handle by attaching the handle either to another part of the handle or also to the paddle; FIG. 18C with a back view of another example of the bubble producing toy of the invention which uses a regular-shaped tab 23 (like that used for a cereal box) and slot 25 (which the tab 23 fits into and which secures the tab 23) at the point of attachment 11 to form the handle. It is an example of using a regular tab 23 and slot 25 to form the handle by attaching the handle either to another part of the handle or also to the paddle; FIG. 18D with an alternate view of FIG. 18C of the invention where the tab 23 and slot 25 for the handle are glued together to further secure them to each other; and FIG. 18E with arrow-shaped tab 27, which holds more securely in the slot 25, even without glue.

A first example of the invention is a bubble producing toy comprising:

a paddle and a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being attached to or part of the paddle and having at least one finger-hole for holding the handle by at least one finger, the handle comprising a material having at least one first portion and at least one second portion, the material being folded on one side thereof so that the at least one first portion and the at least one second portion are folded together, the at least one first portion having at least one first portion finger-hole, and the at least one second portion having at least one second portion finger-hole, the at least one first portion finger-hole and the at least one second portion finger-hole aligning when the material is folded, thereby forming at least one finger-hole in the handle for holding the handle by at least one finger.

There is also a method of using the bubble producing toy described above, comprising holding the toy by the handle, dipping the paddle, or at least a portion thereof, into bubble solution, lifting the paddle out of the bubble solution and waving the paddle back and forth in the air.

Further, in the bubble producing toy described above, the handle can be attached to the paddle opposite the side on which the material is folded.

Still further, in the bubble producing toy described above, the paddle and handle can be formed from a single sheet of material.

Additionally, the bubble producing toy described above can further comprise at least two diaphragm-holes for producing bubbles and the holes are at least one of the following: the same size, the same shape, different sizes, different shapes, round, oval, tennis racket-shaped, triangular-shaped, rectangular-shaped, square-shaped, and/or free-form-shaped.

Additionally, the bubble producing toy described above can further comprise at least two finger-holes in the handle.

Also, the bubble producing toy described above can further comprise at least one slit radiating from a perimeter of at least one of the at least one diaphragm-holes, the slit being capable of holding a quantity of bubble solution and causing the flow of bubble solution due to capillary action when in contact with said bubble solution, whereby the toy can produce more bubbles.

Further, in the bubble producing toy described immediately above, at least one part of the slit can be straight, curved, wiggly or sinuous, have portions containing at least one hole, or any combination thereof.

Still further in the first example of the bubble producing toy described above, the at least one second portion further comprises a tab; and the paddle further comprises a slit, whereby folding the material of the handle aligns the tab with the slit so that the tab can be inserted into the slit to hold the handle together.

Further, in the bubble producing toy described above in the first example, following the description of the figures, at least one of the paddle and/or handle are made of plastic and the plastic is flexible or rigid. Further, as described below, it doesn't even need to be plastic. In any of the examples, high impact polystyrene can also be used.

A second example of the invention is a kit for making a bubble producing toy, comprising:

a sheet of plastic having a front portion, a back portion, an upper portion forming a paddle and a lower portion forming a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being formed from the lower portion of the sheet of plastic and having at least one finger-hole for holding the handle by at least one finger, the handle having at least one first portion, near the upper portion of the sheet of plastic, and at least one second portion, the back portion of the lower portion being folded onto itself to form the handle, the at least one first portion having at least one first portion finger-hole, and the at least one second portion having at least one second portion finger-hole, the at least one first portion finger-hole and the at least one second portion finger-hole aligning when the back portion of the lower portion is folded onto itself, thereby forming the handle with at least one finger-hole in the handle for holding the handle by at least one finger; and packaging for the bubble producing toy, the packaging comprising a water-resistant bubble solution tray shaped to fit at least a portion of the paddle.

Additionally, the example of the kit of the invention can further comprise bubble solution or concentrated bubble solution.

Further, in the example of the kit of the invention, at least one of the front portion and/or the back portion can have an image printed thereon.

A third example of the bubble producing toy comprises (as shown in FIG. 6):

a sheet of plastic with a top half and a bottom half separated by a center line, said top half and bottom half being mirror images of each other, said top half having at least one bubble producing hole and at least one hand gripping hole, and said bottom half having at least one bubble producing hole and at least one hand gripping hole, said at least one top half and bottom half bubble producing holes and said at least one top half and bottom half hand gripping holes aligning when said sheet of plastic is folded along the center line and attached to itself to produce an assembled structure, said at least one hand gripping hole permitting the insertion of one or more fingers for gripping the bubble producing toy, said at least one top half and bottom half bubble producing holes align to produce at least one bubble producing hole between the front and back of said assembled structure, said sheet of plastic having printed upon it at least one image, said bubble producing toy having the capability of being dipped in a bubble solution and creating at least one film across the area of the at least one bubble producing hole, said bubble producing toy then producing bubbles when air is passed through the at least one bubble producing hole or when the toy is shaken through the air in a reciprocating motion.

Additionally, the bubble producing toy of this third example can further comprise at least one slit radiating from a perimeter of the at least one bubble producing hole (also referred to herein as a diaphragm hole), said slit being capable of holding a quantity of bubble solution and causing the flow of bubble solution due to capillary action when in contact with said bubble solution. Also, the slit can be straight, curved, wiggly or sinuous, have portions containing at least one hole, or any combination.

Further, in the bubble producing toy of this third example, the slit can have at least one slit that is straight, curved, wiggly or sinuous, have portions containing at least one hole, or any combination.

Figure 18C:
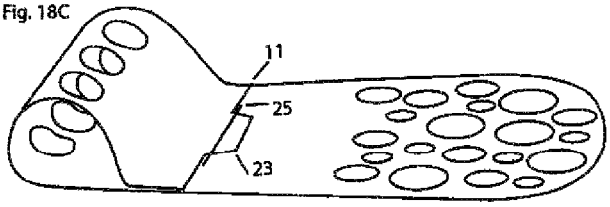
Figure 18D:
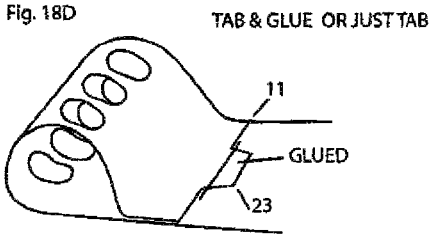
Figure 18E:
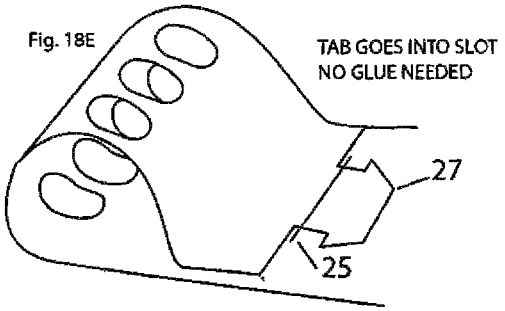

Additionally, the bubble producing toy of example three can further comprise at least one other fold and/or bend or slit and bend to produce a tab that can be attached to itself in said sheet of plastic to provide stiffening to help minimize flexing and/or bending of said assembled structure. Examples of these tabs are shown in FIGS. 18C, 18D and 18E.

Still further, in the bubble producing toy of this third example, the sheet of plastic can be rigid or flexible. Further, as described below, it doesn't even need to be plastic.

With respect to all or some of the examples above, the following descriptions of the invention are included:

The present inventor has a copending application for another bubble producing toy using a paddle and having a kit of components including packaging for holding the bubble producing solution, etc. That application no. 16537747 is hereby incorporated herein by reference in its entirety.

The handle does not have to be made out of the same material as the paddle. Additionally, the handle does not have to be folded out of a material to be formed. Instead, it can be formed from any solid material and finger holes can be drilled into it. For example, the handle can be made from one or more pieces of metal, or wood, composite materials, laminated materials, fabric materials, woven materials, ceramic or cast materials or any combination thereof, and the finger holes can be drilled or formed in them. Generally, in a metal or wood, composite, or laminated material, a drill can be used to make the finger holes, while in fabric materials, woven materials, ceramic or cast materials either a drill can be used to make the finger holes, or the fabric or woven, ceramic or cast materials can be formed into a handle while forming the finger holes.

Bubble producing holes (diaphragm holed) can have radial reservoir slits radiating from the perimeter of the bubble producing holes and this can, via capillary action, hold more bubble solution, thus enabling more bubbles to be produced in a single swiping motion of the bubble producing device. These radial reservoir slits can be straight, curved, wiggly, can have holes in strategic locations, or any combination to maximize the stored bubble solution volume.

There can be additional rigidifying bends within the assembled structure. These rigidizing bends can have multiple cuts and bends to produce tabs that can be attached to itself to stabilize the rigidizing bends, and tabs can be attached in any of the means mentioned herein.

In addition to the basic construction there can be other components forming the assembled structure. These can be molded or cut components attached to the assembled structure. There can be sound producing devices such as bells, chimes, rigid or semi-rigid materials, such as, including, but not limited to, plastic of any kind, metal, wood, ceramics, composite materials, laminated materials, fabric, woven or cast materials, or any combination. There can also be electronic sound producing devices added to the bubble producing toy.

The bubble producing toy can be constructed from multiple layers of at least one material to produce the same general shape and can perform the same function with gripping holes for holding with a hand and bubble producing holes for wetting with bubble solution and producing bubbles.

The bubble producing toy can be an assembly of at least one rigid material and at least one flexible material.

In addition to the bubble producing toy there can be a receptacle or tray or pan or trough designed in such a way as to hold a volume of bubble solution so the bubble producing toy can be dipped within the receptacle to cause a film of bubble solution to be applied to the bubble producing holes.

The bubble producing toy can also comprise an external bubble solution applicator.

The bubble producing toy can also include an integrated bubble solution applicator, such as, including, but not limited, to an arm that swipes linearly or in an arced trajectory across the surface of the paddle.

When the top and bottom portioned are connected to each other, it forms the assembled structure or a bubble producing device that can be dipped into a bubble solution which then forms a film or series of films over the bubble producing holes.

When gripped manually through the gripping holes, the bubble producing device can be waved through the air such that air is forced to flow through the bubble producing holes, and this action can produce bubbles as the soap film closes upon itself. The quantity of bubble solution determines how many bubbles can be produced from each bubble producing hole.

The invention is bubble producing toy comprising a flexible sheet of plastic with a top half and a bottom half separated by a center line. The top half and bottom half can generally be mirror images of each other, but this is not a requirement. Each half can have at least one set of bubble producing holes and a set of hand gripping holes. At least one set of bubble producing holes and hand gripping holes can align when the sheet of plastic is folded about the center line and attached to itself to produce an assembled structure. The hand gripping holes can permit the insertion of fingers for gripping the bubble producing toy. The bubble producing holes align to produce a series of holes between the front and back of the assembled structure. The sheet of plastic can have printed upon it at least one image. The bubble producing toy can have the capability of being dipped in a bubble solution and creating at least one film across the area of at least one bubble producing hole. The bubble producing toy can then produce bubbles when passed or shaken through the air in a reciprocating motion. Any portion of the top half and the bottom half can be in contact with each other to create anything between partial and full contact about a center line.

The bubble producing toy can further comprise at least one slit radiating from the perimeter of at least one bubble producing hole. The slit can be capable of holding a quantity of bubble solution and causing the flow of bubble solution due to capillary action when in contact with bubble solution.

The slit can be at least one slit that is straight, curved, wiggly or sinuous, have portions containing at least one hole, or any combination.

The bubble producing toy can further comprise at least one other fold and/or bend in the sheet of plastic to provide stiffening to help minimize flexing and/or bending of the assembled structure. The third dimension can be utilized by stamping the surface to rigidize the material to minimize flexing of the material when it is shaken back and forth. The bend can also incorporate slits to produce tabs that can be folded to create stabilized bends when attached to itself.

The bubble flexible sheet of plastic can be a rigid sheet of plastic or other material.

The material has a top portion, a middle portion, and a bottom portion, and the top portion and bottom portions are generally mirror images of one another, though some embodiments may be asymmetrical. When folded, the back surface of the top portion is attached to and in contact with the back surface of the bottom portion, and this forms an assembled structure. The top portion and bottom portion have a set of bubble holes and a set of gripping holes. When folded the bubble holes of the top portion align with the bubble holes of the bottom portion and the gripping holes of the top portion align with the gripping holes of the bottom portion. As stated, the alignment and attachment of the top and bottom portions can be from the center line to the most distant points from the center line, with all portions of top area in contact with all portions of the bottom area. There can also be a loop of material in the vicinity of the center line so the area of contact begins at some distance beyond the gripping holes. In other words, the gripping area of assembled structure may be looped to follow the natural curve produced by bending the planar material and attachment of the top and bottom areas in which the bubble holes are located. When aligned, the top bubble holes and bottom bubble holes form bubble producing holes, which pass from one side of the assembled structure to the other. The attachment method can be anything including but not limited thermal welding, melting, cementing, riveting, stitching, stapling, bolting, or other means of attachment.

Although preferred embodiments of the present invention have been described herein it will be understood by those skilled in the art that the present invention should not be limited to the described preferred embodiments. Rather, various changes and modifications can be made within the spirit and scope of the present invention.

All of the material in this patent document and accompanying filings are subject to copyright protection under the copyright laws of the United States and other countries. The copyright owner has no objection to the facsimile reproduction by anyone of the patent document or the patent disclosure and accompanying filings, as it appears in official governmental records but, otherwise, all other copyright rights whatsoever are reserved.

What is claimed is:

1. A bubble producing toy comprising:

a paddle comprising a water-resistant material and a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being attached to or part of the paddle and having at least one finger-hole for holding the handle by at least one finger, the handle comprising a material having at least one first portion and at least one second portion, the material being folded on one side thereof so that the at least one first portion and the at least one second portion are folded together, the at least one first portion having at least one first portion finger-hole in the form of a diaphragm hole, and the at least one second portion having at least one second portion finger-hole in the form of a diaphragm hole, the at least one first portion finger-hole and the at least one second portion finger-hole aligning when the material is folded, thereby forming at least one finger-hole in the handle for holding the handle by at least one finger, wherein the paddle and handle together are formed from a single sheet of material, the at least one first portion of the handle being located on the single sheet of material below the paddle, and the at least one second portion of the handle being located on the single sheet of material below the at least one portion of the handle, when the material is un-folded.

2. A method of using the bubble producing toy of claim 1, comprising holding the toy by the handle, dipping the paddle, or at least a portion thereof, into bubble solution, lifting the paddle out of the bubble solution and waving the paddle back and forth in the air.

3. The bubble producing toy of claim 1, wherein the handle is attached to the paddle opposite the side on which the material is folded.

4. The bubble producing toy of claim 1, further comprising at least two diaphragm-holes for producing bubbles and the holes are at least one of the following: the same size, the same shape, different sizes, different shapes, round, oval, tennis racket-shaped, triangular-shaped, rectangular-shaped, square-shaped, and/or free-form-shaped.

5. The bubble producing toy of claim 1, further comprising at least two finger-holes in the handle.

6. The bubble producing toy of claim 1, wherein the paddle is a diaphragm material and the paddle further comprises at least one slit in the diaphragm material of the paddle which radiates out from a perimeter of at least one of the at least one diaphragm-holes, the slit being capable of holding a quantity of bubble solution and causing the flow of bubble solution due to capillary action when in contact with said bubble solution, whereby the toy can produce more bubbles.

7. The bubble producing toy of claim 6, wherein at least one part of the slit is straight, curved, wiggly or sinuous, has portions containing at least one hole, or any combination thereof.

8. The bubble producing toy of claim 1, wherein at least one of the paddle and/or handle are made of plastic and the plastic is flexible or rigid.

9. A bubble producing toy comprising:

a paddle comprising a water-resistant material and a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being attached to or part of the paddle and having at least one finger-hole for holding the handle by at least one finger, the handle comprising a material having at least one first portion and at least one second portion, the material being folded on one side thereof so that the at least one first portion and the at least one second portion are folded together, the at least one first portion having at least one first portion finger-hole in the form of a diaphragm hole, and the at least one second portion having at least one second portion finger-hole in the form of a diaphragm hole, the at least one first portion finger-hole and the at least one second portion finger-hole aligning when the material is folded, thereby forming at least one finger-hole in the handle for holding the handle by at least one finger, wherein the at least one second portion further comprises a tab; and the paddle further comprises a fastening slit, whereby folding the material of the handle aligns the tab with the fastening slit so that the tab can be inserted into the fastening slit to hold the handle together.

10. A kit for making a bubble producing toy, comprising:

a sheet of plastic having a front portion, a back portion, an upper portion forming a paddle and a lower portion forming a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being formed from the lower portion of the sheet of plastic and having at least one finger-hole for holding the handle by at least one finger, the handle having at least one first portion, near the upper portion of the sheet of plastic, and at least one second portion, the back portion of the lower portion being folded onto itself to form the handle, the at least one first portion having at least one first portion finger-hole, and the at least one second portion having at least one second portion finger-hole, the at least one first portion finger-hole and the at least one second portion finger-hole aligning when the back portion of the lower portion is folded onto itself, thereby forming the handle with at least one finger-hole in the handle for holding the handle by at least one finger; and packaging for the bubble producing toy, the packaging comprising a water-resistant bubble solution tray shaped to fit at least a portion of the paddle.

11. The kit of claim 10, further comprising bubble solution or concentrated bubble solution.

12. The kit of claim 10, wherein at least one of the front portion and/or the back portion has an image printed thereon.

13. A bubble producing toy comprising:

a sheet of plastic with a top half and a bottom half separated by a center line, said top half and bottom half being mirror images of each other, said top half having at least one bubble producing hole and at least one hand gripping hole, and said bottom half having at least one bubble producing hole and at least one hand gripping hole, said at least one top half and bottom half bubble producing holes and said at least one top half and bottom half hand gripping holes aligning when said sheet of plastic is folded along the center line and attached to itself to produce an assembled structure, said at least one hand gripping hole permitting the insertion of one or more fingers for gripping the bubble producing toy, said at least one top half and bottom half bubble producing holes align to produce at least one bubble producing hole between the front and back of said assembled structure, said sheet of plastic having printed upon it at least one image, said bubble producing toy having the capability of being dipped in a bubble solution and creating at least one film across the area of the at least one bubble producing hole, said bubble producing toy then producing bubbles when air is passed through the at least one bubble producing hole or when the toy is shaken through the air in a reciprocating motion.

14. The bubble producing toy of claim 13, further comprising at least one slit radiating from a perimeter of the at least one bubble producing hole, said slit being capable of holding a quantity of bubble solution and causing the flow of bubble solution due to capillary action when in contact with said bubble solution.

15. The bubble producing toy of claim 14, wherein said slit has at least one slit that is straight, curved, wiggly or sinuous, have portions containing at least one hole, or any combination.

16. The bubble producing toy of claim 15, further comprising at least one other fold and/or bend or fastening slit and bend to produce a tab that can be attached to itself in said sheet of plastic to provide stiffening to help minimize flexing and/or bending of said assembled structure.

17. The bubble producing toy of claim 13, wherein said sheet of plastic is rigid or flexible.

18. A bubble producing toy comprising:

a paddle comprising a water-resistant material and a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being attached to or part of the paddle and having at least one finger-hole for holding the handle by at least one finger, the handle comprising a material having at least one first portion and at least one second portion, the material being folded on one side thereof so that the at least one first portion and the at least one second portion are folded together, the at least one first portion having at least one first portion finger-hole in the form of a diaphragm hole, and the at least one second portion having at least one second portion finger-hole in the form of a diaphragm hole, the at least one first portion finger-hole and the at least one second portion finger-hole aligning when the material is folded, thereby forming at least one finger-hole in the handle for holding the handle by at least one finger, wherein at least one of the at least one first portion of the handle or the at least one second portion of the handle further comprises a tab; and another of the at least one first portion of the handle or the at least one second portion of the handle further comprises a fastening slit, whereby folding the material of the handle aligns the tab with the fastening slit so that the tab can be inserted into the fastening slit to hold the handle together.

19. A bubble producing toy comprising:

a paddle and a handle, the paddle having at least one diaphragm-hole for producing bubbles when the paddle is dipped in bubble solution and bubble solution is spread across the at least one diaphragm-hole, and then air is moved through the at least one diaphragm-hole to produce bubbles, the handle being attached to or part of the paddle and having at least one finger-hole for holding the handle by at least one finger, the handle comprising a material having at least one first portion and at least one second portion, the material being folded on one side thereof so that the at least one first portion and the at least one second portion are folded together, the at least one first portion having at least one first portion finger-hole, and the at least one second portion having at least one second portion finger-hole, the at least one first portion finger-hole and the at least one second portion finger-hole aligning when the material is folded, thereby forming at least one finger-hole in the handle for holding the handle by at least one finger;

the at least one second portion further comprises a tab; and the paddle further comprises a fastening slit, whereby folding the material of the handle aligns the tab with the fastening slit so that the tab can be inserted into the fastening slit to hold the handle together.

* * * * *